US011488534B2

(12) United States Patent
Kang et al.

(10) Patent No.: US 11,488,534 B2
(45) Date of Patent: Nov. 1, 2022

(54) DISPLAY DEVICE AND DRIVING METHOD OF THE SAME

(71) Applicant: SAMSUNG DISPLAY CO., LTD., Yongin-si (KR)

(72) Inventors: Byeong Doo Kang, Yongin-si (KR); Jung Taek Kim, Yongin-si (KR); Sung Mo Yang, Yongin-si (KR); Dong Ki Eun, Yongin-si (KR); Yoon Sup Kim, Yongin-si (KR); Yoon Ju Kim, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/475,627

(22) Filed: Sep. 15, 2021

(65) Prior Publication Data

US 2022/0284855 A1 Sep. 8, 2022

(30) Foreign Application Priority Data

Mar. 8, 2021 (KR) ..... 10-2021-0030415

(51) Int. Cl.
*G09G 3/3233* (2016.01)

(52) U.S. Cl.
CPC ..... *G09G 3/3233* (2013.01); *G09G 2310/08* (2013.01); *G09G 2320/0295* (2013.01); *G09G 2320/045* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 9,373,280 | B2 | 6/2016 | Yoon et al. | |
| 9,905,164 | B2 | 2/2018 | Mizukoshi | |
| 11,164,287 | B2 * | 11/2021 | Bonne | H05B 45/50 |
| 2017/0097649 | A1 * | 4/2017 | Lee | G09G 3/3696 |
| 2020/0084854 | A1 * | 3/2020 | Bonne | H05B 47/125 |
| 2021/0251066 | A1 * | 8/2021 | Bonne | H05B 47/18 |

FOREIGN PATENT DOCUMENTS

| | | | |
|---|---|---|---|
| KR | 101908513 | B1 | 10/2018 |
| KR | 101992904 | B1 | 6/2019 |

* cited by examiner

*Primary Examiner* — Dorothy Harris
(74) *Attorney, Agent, or Firm* — Cantor Colburn LLP

(57) ABSTRACT

A display device includes: a low drop-out ("LDO") regulator which provides a second power voltage to a power line during a first period of one frame; a buck converter which provides a first power voltage to the power line during a third period of the one frame; and a pixel connected to the LDO regulator and the buck converter through the power line. A voltage level of the second power voltage is equal to a voltage level of the first power voltage.

20 Claims, 7 Drawing Sheets

DISPLAY DEVICE AND DRIVING METHOD OF THE SAME

This application claims priority to Korean Patent Application No. 10-2021-0030415, filed on Mar. 08, 2021, and all the benefits accruing therefrom under 35 U.S.C. § 119, the conte of which in its entirety is herein incorporated by reference.

BACKGROUND

1. Field

The disclosure generally relates to a display device and a driving method of the display device.

2. Description of the Related Art

With the development of information technologies, the importance of a display device which is a connection medium between a user and information increases. Accordingly, display devices such as a liquid crystal display device and an organic light emitting display device are more widely used in various fields.

An organic light emitting display device uses a self-luminous light-emitting diode, thereby having desired characteristics such as a high response speed, high light emission efficiency, high luminance, and the like. However, degradation of circuit elements including an organic light emitting diode, a transistor, and the like, which are included in each pixel, may occur as driving time is lengthened. In addition, characteristic values of the circuit elements including the organic light emitting diode, the transistor, and the like may be changed as the degradation occurs.

SUMMARY

An organic light emitting display device may include a circuit for sensing and compensating for a characteristic value change or characteristic variation of circuit elements in each pixel. However, noise may be generated in a process of sensing a characteristic value of the pixel, and therefore, the sensing accuracy of the characteristic value may be decreased.

Embodiments provide a display device in which a power source of a pixel sensing circuit for external compensation is connected to both a buck converter and a low drop-out ("LDO") regulator, and a driving method of the display device.

Embodiments also provide a display device in which an output of a buck converter is supplied to a power source in display screen driving and an output of an LDO regulator is supplied to the power source in on/off of a display, and a driving method of the display device.

In accordance with an embodiment of the disclosure, a display device includes: a low drop-out ("LDO") regulator which provides a second power voltage to a power line during a first period of one frame; a buck converter which provides a first power voltage to the power line during a third period of the one frame; and a pixel connected to the LDO regulator and the buck converter through the power line, where a voltage level of the second power voltage is equal to a voltage level of the first power voltage.

In an embodiment, the LDO regulator may be connected to the power line through a second switch, and the buck converter may be connected to the power line through a first switch.

In an embodiment, the display device may further include a timing controller which supplies a second switching control signal to the second switch in the first period, and supplies a first switching control signal to the first switch in the third period, where the first switching control signal turns on the first switch, and the second switching control signal turns on the second switch.

In an embodiment, the first switch and the second switch may be turned off in a second period between the first period and the third period in the one frame. In such an embodiment, the timing controller may not supply the first switching control signal and the second switching control signal in the second period.

In an embodiment, the third period may correspond to a display period in the one frame, and the first period may correspond to a sensing period except the display period in the one frame.

In an embodiment, the LDO regulator may be connected to a timing controller through a second line, and the buck converter may be connected to the timing controller through a first line.

In an embodiment, the timing controller may supply a second control signal to the LDO regulator through the second line in the first period, and supply a first control signal to the buck converter through the first line in the third period.

In an embodiment, the LDO regulator may provide the second power voltage during the first period in response to the second control signal, and the buck converter may provide the first power voltage during the third period in response to the first control signal.

In an embodiment, the timing controller may not supply the first control signal and the second control signal in a second period of the one frame. In to such an embodiment, the second period may be a period between the first period and the third period.

In an embodiment, the third period may correspond to a display period in the one frame, and the first period may correspond to a sensing period in the one frame period.

In accordance with an embodiment of the disclosure, a method for driving a display device including an LDO regulator, a buck converter, and a pixel, the method includes: supplying, by the LDO regulator, a second power voltage to a power line during a first period of one frame; supplying, the buck converter, supplying a first power voltage to the power line during a third period of the one frame; and receiving, by the pixel, the first power voltage or the second power voltage, which is supplied through the power line, where a voltage level of the second power voltage is equal to a voltage level of the first power voltage.

In an embodiment, the LDO regulator may be connected to the power line through a second switch, and the buck converter may be connected to the power line through a first switch.

In an embodiment, the display device may further include a timing controller. In such an embodiment, the supplying the second power voltage to the power line during the first period may include supplying, by the timing controller, a second switching control signal to the second switch during the first period, where the second switching control signal turns on the second switch.

In an embodiment, the supplying the first power voltage to the power line during the third period may include supplying, by the timing controller, a first switching control signal to the first switch during the third period, where the first switching control signal turns on the first switch.

In an embodiment, the first switch and the second switch may be turned off in a second period between the first period and the third period in the one frame. In such an embodiment, the method may further include not supplying, by the timing controller, the first switching control signal and the second switching control signal during the second period.

In an embodiment, the LDO regulator may be connected to a timing controller through a second line, and the buck converter may be connected to the timing controller through a first line.

In an embodiment, the supplying the second power voltage to the power line during the first period may include supplying, by the timing controller, a second control signal to the LDO regulator during the first period.

In an embodiment, the supplying the first power voltage to the power line during the third period may include supplying, by the timing controller, a first control signal to the buck converter during the third period.

In an embodiment, the supplying the second power voltage to the power line during the first period may include supplying, by the LDO regulator, the second power voltage during the first period in response to the second control signal.

In an embodiment, the supplying the first power voltage to the power line during the third period may include supplying, by the buck converter, the to first power voltage during the third period in response to the first control signal.

BRIEF DESCRIPTION OF THE DRAWINGS

The above and other features of the invention will become more apparent by describing in further detail embodiments thereof with reference to the accompanying drawings, in which.

DETAILED DESCRIPTION

Figure 1:
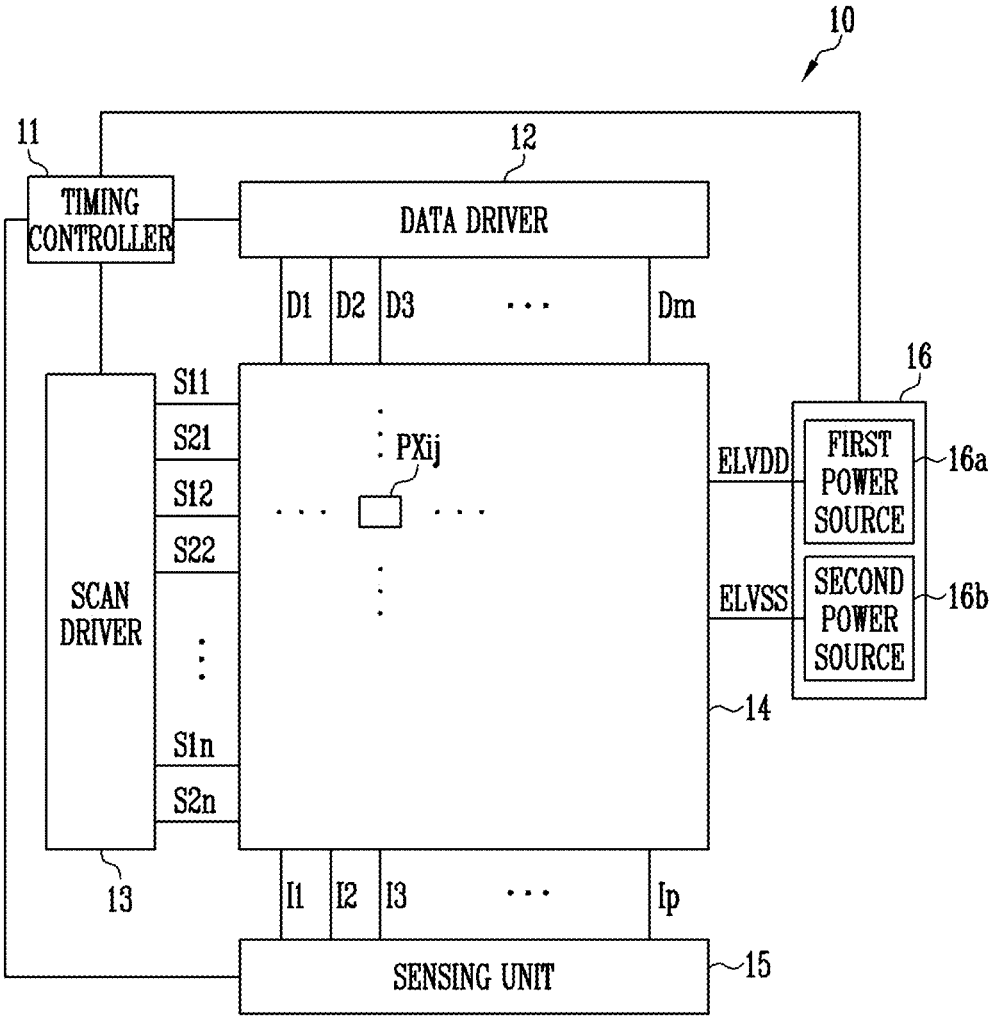
FIG. 1 is a block diagram illustrating a display device in accordance with an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation to of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to the accompanying drawings.

FIG. 1 is a block diagram illustrating a display device in accordance with an embodiment of the disclosure.

Referring to FIG. 1, an embodiment of the display device 10 may include a timing controller 11, a data driver 12, a scan driver 13, a pixel unit 14, a sensing unit 15, and a power source unit 16.

The timing controller 11 may receive grayscale values for each image frame and control signals from an external processor. The timing controller 11 may render the grayscale values to correspond to specifications of the display device 10.

In one embodiment, for example, the external processor may provide a red grayscale value, a green grayscale value, and a blue grayscale value with respect to each unit dot. In an embodiment, where the pixel unit 14 has a pentile structure, adjacent unit dots share a pixel, and therefore, pixels may not correspond one-to-one to the respective grayscale values. Accordingly, in such an embodiment, it is desired to render the grayscale values. In an embodiment where pixels may correspond one-to-one to the respective grayscale values, such rendering of the grayscale values may be omitted.

Grayscale values, which are rendered or are not rendered, may be provided to the data driver 12. To display an image of every frame, the timing controller 11 may provide the data driver 12, the scan driver 13, the sensing unit 15, a power source unit 16, or the like with control signals suitable for specifications of the data driver 12, the scan driver 13, the sensing unit 15, the power source unit 16, or the like.

The data driver 12 may generate data voltages to be provided to data to lines D1, D2, D3, . . . , and Dm by using grayscale values and control signals. In one embodiment, for example, the data driver 12 may sample grayscale values by using a clock signal, and apply data voltages corresponding to the grayscale values to the data lines D1, D2, D3, . . . , and Dm in units of pixel rows. Here, m may be an integer greater than 0. The pixel rows may mean pixels connected to the same scan line.

The scan driver 13 may generate first scan signals to be provided to first scan lines S11, S12, . . . , and S1*n* and second scan signals to be provided to second scan lines S21, S22, . . . , and S2*n*, by receiving a clock signal, a scan start signal, and the like from the timing controller 11. Here, n may be an integer greater than 0.

The scan driver 13 may sequentially supply the first scan signals having a pulse of a turn-on level to the first scan lines S11, S12, . . . , and S1*n*. Also, the scan driver 13 may sequentially supply the second scan signals having a pulse of a turn-on level to the second scan lines S21, S22, . . . , and S2*n*.

In one embodiment, for example, the scan driver 13 may include a first scan driver connected to the first scan lines S11, S12, . . . , and S1*n* and a second scan driver connected to the second scan lines S21, S22, . . . , and S2*n*. Each of the first scan driver and the second scan driver may include scan stages configured in the form of shift registers. Each of the first scan driver and the second scan driver may generate scan signals in a manner such that the scan start signal in the form of a pulse of a turn-on level is sequentially transferred to a next scan stage under the control of the clock signal.

In an embodiment, the first scan signals and the second scan signals may be the same as each other. In such an embodiment, a first scan line and a second scan line, which are connected to each pixel PXij, may be connected to a same node. In an embodiment, the scan driver 13 is not divided into the first scan driver and the second driver, but may be configured as a single scan driver.

The sensing unit 15 may include sensing channels connected to sensing lines I1, I2, I3, . . . , and Ip. In one embodiment, for example, the sensing lines I1, I2, I3, . . . , and Ip and the sensing channels may correspond one-to-one to each other.

The power source unit 16 may include a first power source 16*a* and a second power source 16*b*. The first power source 16*a* and the second power source 16*b* may be configured with different integrated chips ("IC"s), or be defined by blocks in a single IC. The first power source 16*a* may be commonly connected to the pixels through a first power line ELVDD. The second power source 16*b* may be commonly connected to the pixels through a second power line ELVSS. The first power source 16*a* may supply a power voltage through the first power line ELVDD. The second power source 16*b* may supply a power voltage through the second power line ELVSS. During a display period of the pixel unit 14, the power voltage supplied through the first power line ELVDD may be higher than that supplied through the second power line ELVSS. During the display period of the pixel unit 14, a current path, which passes through the first power source 16*a*, the first power line ELVDD, the pixel unit 14, to the second power line ELVSS, and the second power source 16*b*, may be formed.

Hereinafter, a pixel in accordance with an embodiment of the disclosure will be described with reference to FIG. 2.

Figure 2:
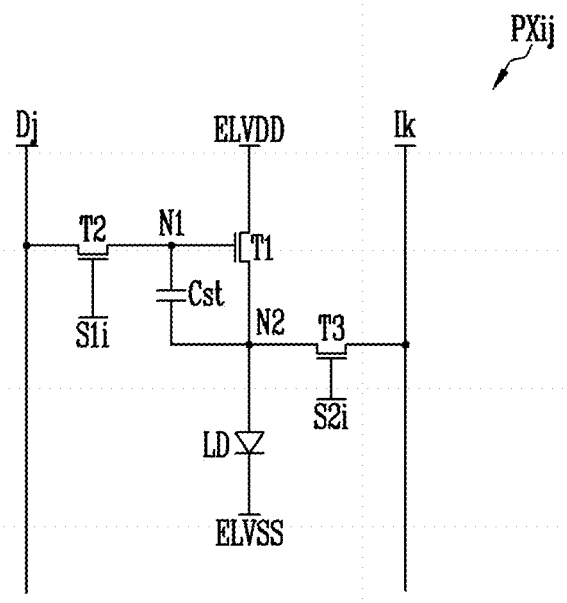
FIG. 2 is a circuit diagram illustrating a pixel in accordance with an embodiment of the disclosure.

FIG. 2 is a circuit diagram illustrating a pixel in accordance with an embodiment of the disclosure.

Referring to FIG. 2, an embodiment of the pixel PXij may include transistors T1, T2, and T3, a storage capacitor Cst, and a light emitting diode LD.

In an embodiment, the transistors T1, T2, and T3 may be implemented with an N-type transistor. In an alternative embodiment, the transistors T1, T2, and T3 may be implemented with a P-type transistor. In another alternative embodiment, the transistors T1, T2, and T3 may be implemented with a combination of the N-type and P-type transistors. The P-type transistor generally refers to a transistor in which an amount of current flowing increases when a voltage difference between a gate electrode and a source electrode increases in a negative direction. The N-type transistor generally refers to a transistor in which an amount of current flowing increases when a voltage difference between a gate electrode and a source electrode increases in a positive direction. The transistor may be configured in various forms such as a thin film transistor ("TFT"), a field effect transistor ("FET"), a bipolar junction transistor ("BJT"), and a metal oxide semiconductor ("MOS") transistor.

In an embodiment, a gate electrode of a first transistor T1 may be to connected to a first node N1, a first electrode of the first transistor T1 may be connected to a first power line ELVDD, and a second electrode of the first transistor T1 may be connected to a second node N2. The first transistor T1 may be referred to as a driving transistor.

A gate electrode of a second transistor T2 may be connected to a first scan line S1*i*, a first electrode of the second transistor T2 may be connected to a data line Dj, and a second electrode of the second transistor T2 may be connected to the first node N1. The second transistor T2 may be referred to as a scanning transistor.

A gate electrode of a third transistor T3 may be connected to a second scan line S2*i*, a first electrode of the third transistor T3 may be connected to the second node N2, and a second electrode of the third transistor T3 may be connected to a sensing line Ik. The third transistor T3 may be referred to as a sensing transistor.

A first electrode of the storage capacitor Cst may be connected to the first node N1, and a second electrode of the storage capacitor Cst may be connected to the second node N2.

An anode of the light emitting diode LD may be connected to the second node N2, and a cathode of the light emitting diode LD may be connected to a second power line ELVSS. The light emitting diode LD may be configured as an organic light emitting diode, an inorganic light emitting diode, a quantum dot/well light emitting diode, etc. In an embodiment, the light emitting diode LD may be configured with a plurality of light emitting diodes connected in series, parallel, or series/parallel with each other.

During a display period, a voltage level of a power voltage supplied through the first power line ELVDD may be higher than that of a power voltage supplied through the second power line ELVSS. In an embodiment, the voltage level of the power voltage supplied through the second power line ELVSS may be selectively set higher than that of the power voltage supplied through the first power line ELVDD in a situation where light emission of the light emitting diode LD is desired to be prevented.

Hereinafter, a driving method of the pixel in accordance with an embodiment of the disclosure will be described with reference to FIG. 3.

Figure 3:
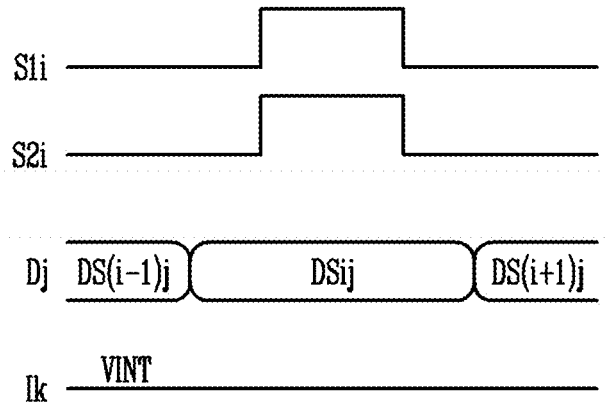
FIG. 3 is a signal timing diagram illustrating a driving method of the pixel in accordance with an embodiment of the disclosure.

FIG. 3 is a signal timing diagram illustrating a driving method of the pixel in accordance with an embodiment of the disclosure.

FIG. 3 shows waveforms of signals applied to the scan lines S1*i* and S2*i*, the data line Dj, and the sensing line Ik, which are connected to the pixel PXij, during a horizontal period corresponding to the scan lines S1*i* and S2*i*. Here, k may be an integer greater than 0. One frame period may include a plurality of horizontal periods corresponding to pixel rows.

An initialization voltage VINT may be applied to the sensing line Ik.

Data voltages DS(i−1)j, DSij, and DS(i+1)j may be sequentially applied to the data line Dj in units of horizontal periods. A first scan signal of a turn-on level (logic high level) may be applied to the first scan line S1*i* in a corresponding horizontal period. In addition, a second scan signal of a turn-on level may be applied to the second scan line S2*i* in synchronization with the first scan line S1*i*.

In one embodiment, for example, when scan signals of a turn-on level are applied to the first scan line S1*i* and the second scan line S2*i*, the second transistor T2 and the third transistor T3 may be in a turn-on state. Therefore, a voltage corresponding to a difference between the data voltage DSij and the initialization voltage VINT is written in the storage capacitor Cst of the pixel PXij.

In the pixel PXij, an amount of driving current flowing through a driving path connecting the first power line ELVDD, the first transistor T1, the light emitting diode LD, and the second power line ELVSS is determined based on a voltage difference between the gate electrode and a source electrode of the first transistor T1. An emission luminance of the light emitting diode LD may correspond to the amount of driving current.

Subsequently, when the scan signal of a turn-off level (logic low level) is applied to the first scan line S1*i* and the second scan line S2*i*, the second transistor T2 and the third transistor T3 may be in a turn-off state. Therefore, the voltage difference between the gate electrode and the source electrode of the first transistor T1 may be maintained by the storage capacitor Cst, regardless of a change in voltage of the data line Dj, and the emission luminance of the light emitting diode LD may be maintained.

Hereinafter, a first power source and a timing controller in accordance with an embodiment of the disclosure will be described with reference to FIG. 4.

Figure 4:
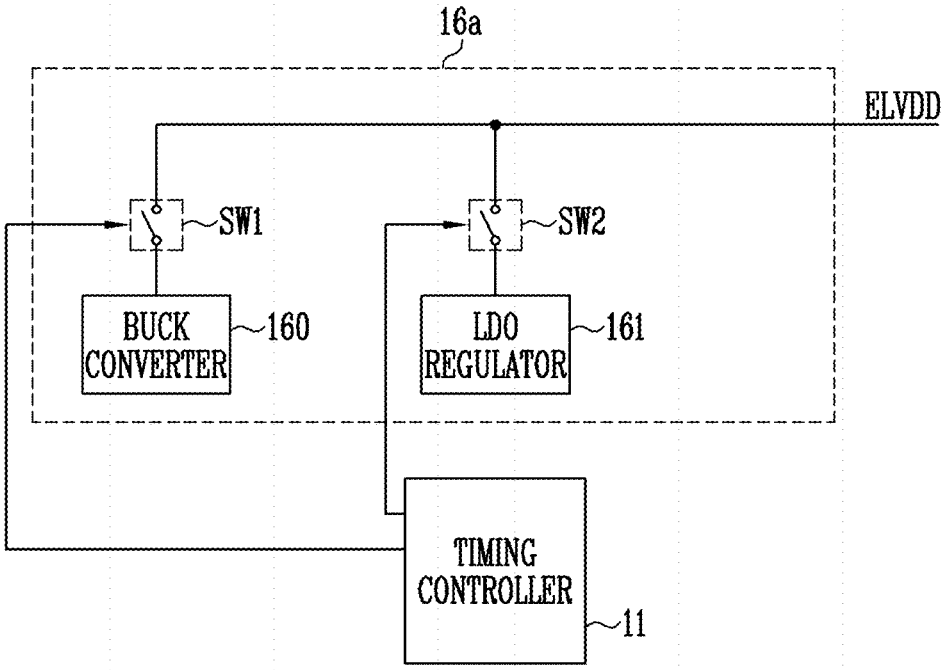
FIG. 4 is a block diagram illustrating a first power source and a timing controller in accordance with an embodiment of the disclosure.

FIG. 4 is a block diagram illustrating a first power source and a timing controller in accordance with an embodiment of the disclosure.

Referring to FIG. 4, an embodiment of the first power source 16*a* may include a buck converter 160, a low drop-out ("LDO") regulator 161, a first switch SW1, and a second switch SW2.

The buck converter 160 may be connected to a first power line ELVDD through the first switch SW1.

In such an embodiment, when the first switch SW1 is in the turn-on state by a first switching control signal of the timing controller 11, the buck converter 160 may apply a voltage of a first level to the first power line ELVDD. The voltage of the first level may be a first power voltage using in the pixel PXij during a display period.

The LDO regulator 161 may be connected to the first power line ELVDD through the second switch SW2.

In such an embodiment, when the second switch SW2 is in the turn-on state by a second switching control signal of the timing controller 11, the LDO regulator 161 may apply a voltage of a second level to the first power line ELVDD. The voltage of the second level may be a second power voltage used in the pixel PXij during a sensing period except the display period.

The sensing period except the display period means a period in which unique characteristic values of circuit elements included in the pixel PXij are sensed through external compensation at the moment when the display device 10 is turned on or turned off.

In an embodiment, the second power voltage output from the LDO regulator 161 at the moment when the display device 10 is turned on or turned off may be supplied to the pixel PXij through the first power line ELVDD, and the sensing unit 15 may sense unique characteristic values of circuit elements included in the pixel PXij by using the second power voltage.

A voltage level of the voltage used in the pixel PXij in the display period is equal to that of the voltage used in the pixel PXij in the sensing period except the display period. Therefore, a voltage level of the first power voltage is equal to that of the second power voltage.

In an embodiment of the disclosure, the first switch SW1 and the second switch SW2 may not be simultaneously in the turn-on state, and the state of any one of the first switch SW1 and the second switch SW2 may be changed to the turn-on state by a switching control signal (first switching control signal or second switching control signal) of the timing controller 11.

In such an embodiment, the timing controller 11 may supply, to the first switch SW, a first switching control signal for changing the state of the first switch SW1 to the turn-on state to supply the first power voltage used in the pixel PXij in the display period to the pixel PXij through the first power line ELVDD. In such an embodiment, the timing controller 11 may supply, to the second switch SW2, a second switching control signal for changing the state of the second switch SW1 to the turn-on state to supply the second power voltage used in the pixel PXij in the sensing period except the display period to the pixel PXij through the first power line ELVDD.

Hereinafter, a driving method of the buck converter and the LDO regulator in first to third periods in accordance with an embodiment of the disclosure will be described with reference to FIG. 5.

Figure 5:
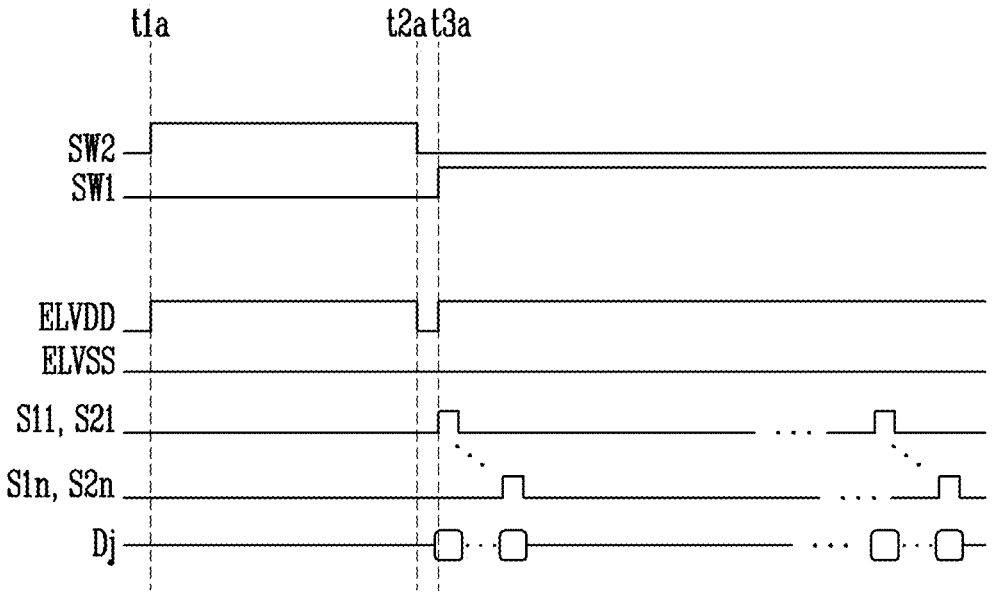
FIG. 5 is a signal timing diagram illustrating a driving method of a buck converter and a low drop-out ("LDO") regulator in first to third periods in accordance with an embodiment of the disclosure.

FIG. 5 is a signal timing diagram illustrating a driving method of the buck converter and the LDO regulator in first to third periods in accordance with an embodiment of the disclosure.

The first period is a period from a first time point t1*a* to a second time point t2*a*, and means a sensing period except a display period. The third period is a period after a third time point t3*a*, and means the display period. The second period is a period from the second time point t2*a* to the third time point t3*a*, and means a period between the sensing period except the display period and the display period.

In the first period, the timing controller 11 applies, to the second switch SW2, a second switching control signal for changing the state of the second switch SW2 to the turn-on state. The second switch SW2 is maintained in the turn-on state from the first time point t1*a* to the second time point t2*a*. In the first period, since any switching control signal for changing the state of the first switch SW1 to the turn-on state is not applied to the first switch SW1 from the timing controller 11, the first switch SW1 is maintained in the turn-off state from the time t1*a* to the time t2*a*.

In the first period, the LDO regulator 161 may be connected to the first power line ELVDD through the second switch SW2. The LDO regulator 161 may apply a voltage of a second level to the first power line ELVDD. The voltage of a second level may be a second power voltage.

The second period or the period from the second time point t2*a* to the third time point t3*a* corresponds to a dead time, and is a period between the sensing period except the display period and a time at which the display period is started. The dead time means a state in which the display device 10 is turned off.

Since any switching control signal (first switching control signal or second switching control signal) for changing the state of the first switch SW1 and the second switch SW2 to the turn-on state is not applied to the first switch SW1 and the second switch SW2 from the timing controller 11, the first switch SW1 and the second switch SW2 are maintained in the turn-off state from the second time point t2*a* to the third time point t3*a*.

In the third period, the timing controller 11 applies, to the first switch SW1, a first switching control signal for changing the state of the first switch SW1 to the turn-on state. The first switch SW1 is maintained in the turn-on state after the third time point t3*a*. In the third period, since the second switching control signal for changing the state of the second switch SW2 to the turn-on state is not applied to the second switch SW2 from the timing controller 11, the second switch SW2 is maintained in the turn-off state after the third time point t3*a*.

In the third period, the buck converter 160 may be connected to the first power line ELVDD through the first switch SW1. The buck converter 160 may apply a voltage of a first level to the first power line ELVDD. The voltage of the first level may be a first power voltage.

In an embodiment, as shown in FIG. 5, the third period corresponding to the display period may be longer than the first period corresponding to the sensing period. In such an embodiment, in the third period corresponding to the display period, the first switch SW1 may be in the turn-on state, and the buck converter may output the first power voltage having a same voltage level as the second power voltage to the first power line ELVDD such that the first power voltage is applied to the pixel PXij. In the first period corresponding to the sensing period except the display period, the second switch SW2 may be in the turn-on state, and the LDO regulator 161 may apply the second power voltage having a same voltage level as the first power voltage to the first power line ELVDD such that the second power voltage is applied to the pixel PXij.

In accordance with an embodiment of the disclosure, in the sensing period except the display period, the second power voltage is provided to the first power line ELVDD by using the LDO regulator 161, and the pixel PXij is driven by using the second power voltage. The second power voltage output from the LDO regulator 161 has noise lower than that of the first power voltage output from the buck converter 160 to be applied to the first power line ELVDD, and thus the pixel PXij may be stably driven through the first power line ELVDD in the sensing period except the display period.

In such an embodiment, the buck converter 160 generates a power source by using a switching operation, and accordingly, ripples are generated in the power source. Accordingly, noise may be generated in a power voltage output from the buck converter 160. Therefore, the voltage applied to the first power line ELVDD of the pixel PXij may be differently set according to the time at which a voltage (or current) is sensed during the sensing period, and accordingly, the accuracy of sensing is decreased.

In such an embodiment, the LDO regulator 161 has large power loss and low efficiency in which a power source is generated, as compared with the buck converter 160. However, the LDO regulator 161 generates a power source without any switching operation. Thus, generation of ripples in the power source is minimized, such that the voltage applied to the first power source line ELVDD of the pixel PXij may be constantly set according to the time at which the voltage (or current) is sensed during the sensing period. Accordingly, the accuracy of sensing may be increased.

Hereinafter, a first power source and a timing controller in accordance with an alternative embodiment of the disclosure will be described with reference to FIG. 6.

Figure 6:
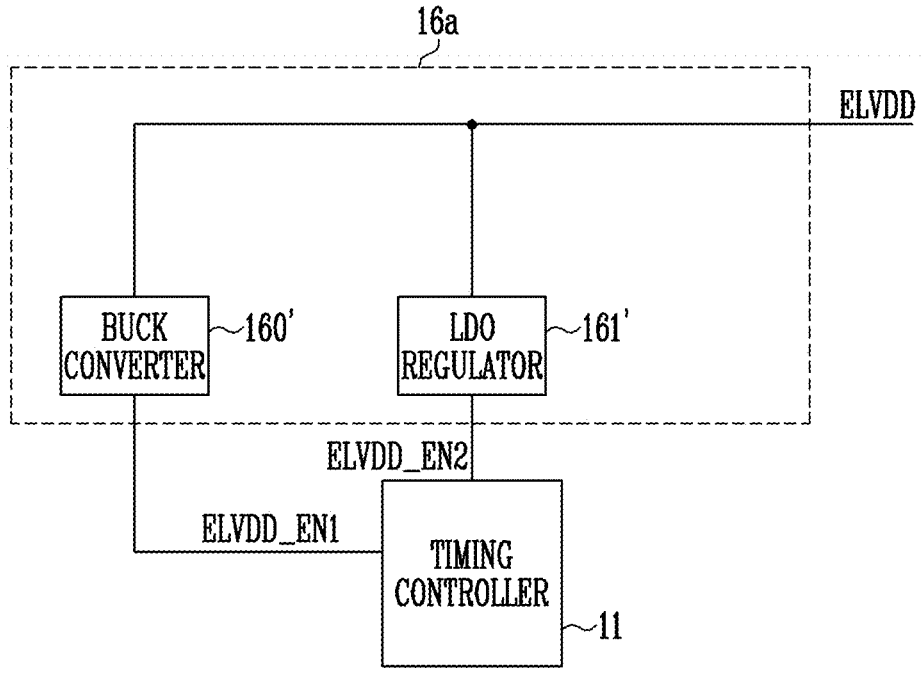
FIG. 6 is a block diagram illustrating a first power source and a timing controller in accordance with an alternative embodiment of the disclosure.

FIG. 6 is a block diagram illustrating a first power source and a timing controller in accordance with an alternative embodiment of the disclosure.

In an alternative embodiment, one end of a buck converter 160' may be connected to the timing controller 11 through a first line ELVDD_EN1, and the other end of the buck converter 160' may be connected to a first power line ELVDD.

In such an embodiment, when the timing controller 11 applies a first control signal to the buck converter 160' through the first line ELVDD_EN1, the buck converter 160' may apply a voltage of a first level to the first power line ELVDD. In such an embodiment, as described above with reference to FIG. 4, the voltage of the first level may be a first power voltage used in the pixel PXij during the display period.

In such an embodiment, one end of an LDO regulator 161' may be connected to the timing controller 11 through a second line ELVDD_EN2, and another end of the LDO regulator 161' may be connected to the first power line ELVDD.

In such an embodiment, when the timing controller 11 applies a second control signal to the LDO regulator 161' through the second line ELVDD_EN2, the LDO regulator 161' may apply a voltage of a second level to the first power line ELVDD. In such an embodiment, as described above with reference to FIG. 4, the voltage of the second level may be a second power voltage used in the pixel PXij during the sensing period except the display period.

A voltage level of a voltage used in the pixel PXij in the display period is equal to that of a voltage used in the pixel PXij in the sensing period except the display period, and therefore, a voltage level of the first power source may be equal to that of the second power source.

In an embodiment of the disclosure, the first control signal supplied to the buck converter 160' and the second control signal supplied to the LDO regulator 161' may not be simultaneously output from the timing controller 11.

In such an embodiment, any one of the first power voltage and the second power voltage may be applied to the first power line ELVDD from the buck converter 160' or the LDO regulator 161' by the first control signal or the second control signal, which is output from the timing controller 11.

In such an embodiment, the timing controller 11 may supply the first control signal to the buck converter 160' to supply the first power voltage used in the pixel PXij in the display period. In such an embodiment, the timing controller 11 may supply the second control signal to the LDO regulator 161' to supply the second power voltage used in the pixel PXij in the sensing period except the display period.

Hereinafter, a driving method of the buck converter and the LDO regulator in accordance with an alternative embodiment of the disclosure will be described with reference to FIG. 7.

Figure 7:
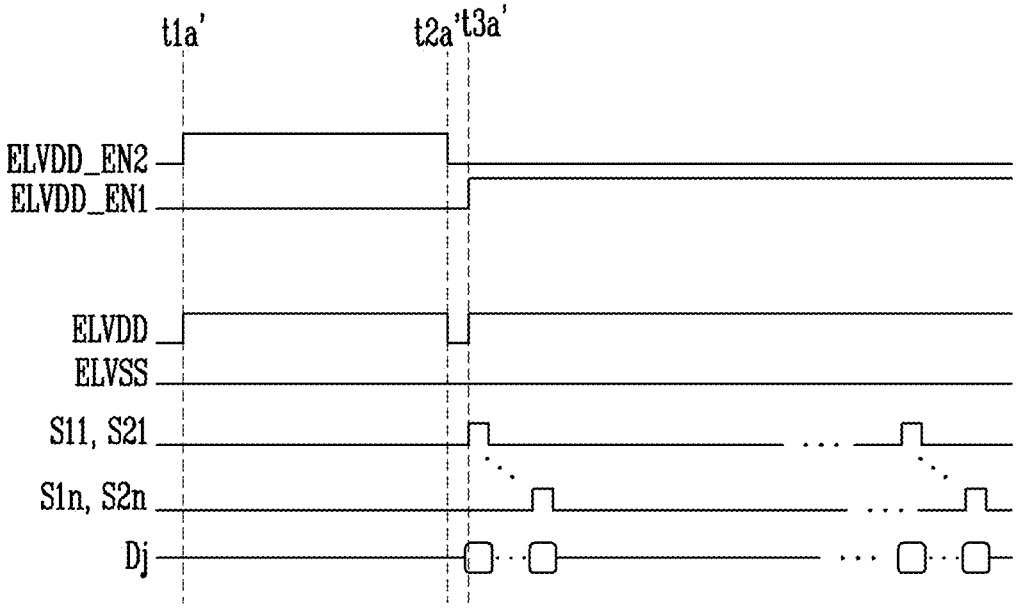
FIG. 7 is a signal timing diagram illustrating a driving method of the buck converter and the LDO regulator in first to third periods in accordance with an alternative embodiment of the disclosure.

FIG. 7 is a signal timing diagram illustrating a driving method of the buck converter and the LDO regulator in first to third periods in accordance with an alternative embodiment of the disclosure.

The first period is a period from a first time point t1*a*' to a second time point t2*a*', and means a sensing period except a display period. The third period is a period after a third time point t3*a*', and means the display period. The second period is a period from the second time point t2*a*' to the third time point t3*a*', and means a period between the sensing period except the display period and the display period.

In the first period, the timing controller 11 applies the second control signal to the LDO regulator 161' through the second line ELVDD_EN2. In the period from the first time point t1*a*' to the second time point t2*a*', the to timing controller 11 continuously supplies the second control signal through the second line ELVDD_EN2. In the first period, the timing controller 11 does not apply the first control signal to the buck converter 160' through the first line ELVDD_EN1.

In the first period, the LDO regulator 161' to which the second control signal is applied may apply a voltage of a second level to the first power line ELVDD. The voltage of the second level may be the second power voltage.

The second period or the period from the second time point t2*a*' to the third time point t3*a*' corresponds to a dead time, and is a period between the sensing period except the display period and a time at which the display period is started. During the second period, the first control signal and the second control signal are not applied to the buck converter 160' and the LDO regulator 161' from the timing controller 11, and therefore, the buck converter 160' and the LDO regulator 161' do not apply the first power voltage and the second power voltage to the first power line ELVDD.

In the third period, the timing controller 11 applies the first control signal to the buck converter 160' through the first line ELVDD_EN1. After the third time point t3*a*', the timing controller 11 continuously supplies the first control signal through the first line ELVDD_EN1. In the third period, the timing controller 11 does not apply the second control signal to the LDO regulator 161' through the second line ELVDD_EN2.

In the third period, the buck converter 160' to which the first control signal is applied may apply a voltage of a first level to the first power line ELVDD. The voltage of the first level may be the first power voltage.

In an embodiment, as shown in FIG. 7, the third period corresponding to the display period may be longer than the first period corresponding to the sensing period. In the third period corresponding to the display period, the first control signal may be supplied to the buck converter 160' through the first line ELVDD_EN1, and the buck converter 160' may output the first power voltage having a same voltage level as the second power voltage to the first power line ELVDD such that the first power voltage is applied to the pixel PXij. In the first period corresponding to the sensing period except the display period, the second control signal may be supplied to the LDO regulator 161' through the second line ELVDD_EN2, and the LDO regulator 161' may output the second power voltage having a same voltage level as the first power voltage to the first power line ELVDD such that the second power voltage is applied to the pixel PXij.

According to an embodiment, as shown in FIGS. 6 and, the first switch SW1 and the second switch SW2 are not included such that power consumption may be reduced. In such an embodiment, the second power voltage having noise lower than that of the first power voltage is applied to the pixel PXij through the first power line ELVDD in the sensing period except the display period, such that the pixel PXij may be stably driven.

In embodiments of the display device and the driving method of the display device in accordance with the disclosure, the buck converter and the LDO regulator may be simultaneously connected to a power source of the pixel sensing circuit for external compensation.

In embodiments of the display device and the driving method of the display device in accordance with the disclosure, an output of the buck converter is supplied to a power source in display screen driving, and an output of the LDO regulator is supplied to the power source in on/off of the display. Accordingly, influence of noise may be minimized, and the characteristic sensing accuracy of the pixel may be increased.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims . . .

What is claimed is:

1. A display device comprising:

a low drop-out regulator which provides a second power voltage to a power line during a first period of one frame;

a buck converter which provides a first power voltage to the power line during a third period of the one frame; and a pixel connected to the low drop-out regulator and the buck converter through the power line, wherein a voltage level of the second power voltage is equal to a voltage level of the first power voltage.

2. The display device of claim 1, wherein the low drop-out regulator is connected to the power line through a second switch, and the buck converter is connected to the power line through a first switch.

3. The display device of claim 2, further comprising:

a timing controller which supplies a second switching control signal to the second switch in the first period, and supplies a first switching control signal to the first switch in the third period, wherein the first switching control signal turns on the first switch, and the second switching control signal turns on the second switch.

4. The display device of claim 3, wherein the first switch and the second switch are turned off in a second period between the first period and the third period in the one frame, and wherein the timing controller does not supply the first switching control signal and the second switching control signal in the second period.

5. The display device of claim 4, wherein the third period corresponds to a display period in the one frame, and the first period corresponds to a sensing period in the one frame.

6. The display device of claim 1, wherein the low drop-out regulator is connected to a timing controller through a second line, and the buck converter is connected to the timing controller through a first line.

7. The display device of claim 6, wherein the timing controller supplies a second control signal to the low drop-out regulator through the second line in the first period, and supplies a first control signal to the buck converter through the first line in the third period.

8. The display device of claim 7, wherein the low drop-out regulator provides the second power voltage during the first period in response to the second control signal, and the buck converter provides the first power voltage during the third period in response to the first control signal.

9. The display device of claim 8, wherein the timing controller does not supply the first control signal and the second control signal in a second period of the one frame, and wherein the second period is a period between the first period and the to third period.

10. The display device of claim 9, wherein the third period corresponds to a display period in the one frame, and the first period corresponds to a sensing period in the one frame period.

11. A method of driving a display device including a low drop-out regulator, a buck converter, and a pixel, the method comprising:

supplying, by the low drop-out regulator, a second power voltage to a power line during a first period of one frame;

supplying, the buck converter, supplying a first power voltage to the power line during a third period of the one frame; and receiving, by the pixel, the first power voltage or the second power voltage, which is supplied through the power line, wherein a voltage level of the second power voltage is equal to a voltage level of the first power voltage.

12. The method of claim 11, wherein the low drop-out regulator is connected to the power line through a second switch, and the buck converter is connected to the power line through a first switch.

13. The method of claim 12, wherein the display device further includes to a timing controller, and wherein the supplying the second power voltage to the power line during the first period includes supplying, by the timing controller, a second switching control signal to the second switch during the first period, wherein the second switching control signal turns on the second switch.

14. The method of claim 13, wherein the supplying the first power voltage to the power line during the third period includes supplying, by the timing controller, a first switching control signal to the first switch during the third period, wherein the first switching control signal turns on the first switch.

15. The method of claim 14, wherein the first switch and the second switch are turned off in a second period between the first period and the third period in the one frame, and wherein the method further comprises not supplying, by the timing controller, the first switching control signal and the second switching control signal during the second period.

16. The method of claim 11, wherein the low drop-out regulator is connected to a timing controller through a second line, and the buck converter is connected to the timing controller through a first line.

17. The method of claim 16, wherein the supplying the second power voltage to the power line during the first period includes supplying, by the timing controller, a second control signal to the low drop-out regulator during the first period.

18. The method of claim 17, wherein the supplying the first power voltage to the power line during the third period includes supplying, by the timing controller, a first control signal to the buck converter during the third period.

19. The method of claim 18, wherein the supplying the second power voltage to the power line during the first period includes supplying, by the low drop-out regulator, the second power voltage during the first period in response to the second control signal.

20. The method of claim 19, wherein the supplying the first power voltage to the power line during the third period includes supplying, by the buck converter, the first power voltage during the third period in response to the first control signal.

* * * * *